US005899605A

United States Patent [19]

Caruthers, Jr. et al.

[11] Patent Number: 5,899,605

[45] Date of Patent: May 4, 1999

[54] COLOR MIXING AND COLOR SYSTEM FOR USE IN A PRINTING MACHINE

[75] Inventors: Edward B. Caruthers, Jr.; R. Enrique Viturro, both of Rochester, N.Y.

[73] Assignee: Xerox Corporation, Stamford, Conn.

[21] Appl. No.: 09/093,703

[22] Filed: Jun. 8, 1998

Related U.S. Application Data

[63] Continuation-in-part of application No. 08/721,421, Sep. 26, 1996.

[51] Int. Cl.[6] ..... G03G 15/01

[52] U.S. Cl. ..... 399/223; 399/53; 399/57; 399/233

[58] Field of Search ..... 399/53, 54, 57, 399/58, 61, 62, 64, 222, 223, 224, 233, 237, 238; 430/117, 137; 356/405, 406, 407, 409, 410, 411, 414, 415, 425; 250/226, 573, 576

[56] References Cited

U.S. PATENT DOCUMENTS

| | | | |
|---|---|---|---|
| 4,111,151 | 9/1978 | Ruckdeschel . | |
| 4,278,538 | 7/1981 | Lawrence et al. | 250/226 X |
| 4,402,611 | 9/1983 | Yuasa | 356/405 |
| 5,012,299 | 4/1991 | Sawamura et al. . | |
| 5,204,208 | 4/1993 | Paine et al. | 430/137 |
| 5,240,806 | 8/1993 | Tang et al. | 430/115 |
| 5,369,476 | 11/1994 | Bowers et al. . | |
| 5,543,896 | 8/1996 | Mestha . | |
| 5,557,393 | 9/1996 | Goodman et al. . | |

OTHER PUBLICATIONS

Xerox Disclosure Journal—vol. 21, No. 2 Mar./Apr. 1996 entitled: "Customer Color Liquid Ink Development" by Nancy B. Goodman. pp. 155–156.

Xerox Disclosure Journal—vol. 21, No. 2 Mar./Apr. 1996 entitled: "Customer Color Liquid Ink Development (LID) Process" by Nancy B. Goodman. p. 157.

*Primary Examiner*—Sandra Brase

*Attorney, Agent, or Firm*—D. A. Robitaille; R. Hutter

[57] ABSTRACT

A system for determining, in real time, the precise color measurements of a colorant being applied in a printing apparatus, the colorant being a combination of two or more primary colorants. Light from a light source is transmitted through or reflected from the colorant mixture, and received by a sensor having a relatively small number of photodetectors, each photodetector having a different translucent primary-color filter thereon. Various special algorithms can be used to approach the accuracy of a spectrophotometer using a relatively simple light sensor.

36 Claims, 2 Drawing Sheets

COLOR MIXING AND COLOR SYSTEM FOR USE IN A PRINTING MACHINE

CONTINUATION-IN-PART APPLICATION

The present application is a continuation-in-part of U.S. patent application Ser. No. 08/721,421, filed Sep. 26, 1996.

FIELD OF THE INVENTION

This invention relates generally to a development system for creating color output images in a printing machine. The color mixing and control system operates by sensing the color of an operational mixture of developing material comprised of a blend of multiple basic color components and controlling the concentration of respective basic color components used to replenish the operational mixture.

BACKGROUND OF THE INVENTION

Generally, the process of electrostatographic copying and printing is initiated by exposing a light image of an original input document or signal onto a substantially uniformly charged photoreceptive member. Exposing the charged photoreceptive member to a light image discharges selective areas of the photoreceptive member, creating an electrostatic latent image on the photoreceptive member corresponding to the original input document or signal. This latent image is subsequently developed into a visible image by a process in which developing material is deposited onto the surface of the photoreceptive member. Typically, the developing material comprises carrier granules having toner particles adhering triboelectrically thereto, wherein the toner particles are electrostatically attracted from the carrier granules to the latent image to create a powder toner image on the photoreceptive member. Alternatively, liquid developing materials comprising pigmented marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are electrostatically attracted to the latent image to form a developed image and the developed image is subsequently transferred from the photoreceptive member to a copy substrate, either directly or via an intermediate transfer member. Once on the copy substrate, the image may be permanently affixed to provide a "hard copy" output document. In a final step, the photoreceptive member is cleaned to remove any charge and/or residual developing material from the photoconductive surface in preparation for subsequent imaging cycles.

The above-described electrostatographic reproduction process is well known and is useful for so-called light lens copying from an original document, as well as for printing of electronically generated or stored images where the electrostatic latent image is formed via a modulated laser beam. Analogous processes also exist in other printing applications such as, for example, ionographic printing and reproduction where charge is deposited in image configuration on a charge retentive surface (see, for example, U.S. Pat. No. 4,267,556 and 4,885,220, among numerous other patents and publications). Some of these printing processes, such as light lens generated image systems operate in a manner wherein the charged areas are developed (so-called CAD, or "write white" systems), while other printing processes operate in a manner such that discharged areas are developed (so-called DAD, or "write black" systems). It will be understood that the instant invention applies to all various types of electrostatographic printing systems and is not intended to be limited by the manner in which the image is formed or developed.

It is well known that conventional electrostatographic reproduction processes can be adapted to produce multicolor images. For example, the charged photoconductive member may be sequentially exposed to a series of color separated images corresponding to the primary colors in an input image in order to form a plurality of color separated latent images. Each color separated image is developed with a complimentary developing material containing a primary color or a colorant which is the subtractive compliment of the color separated image, with each developed color separated image subsequently superimposed, in registration, on one another to produce a multicolor image output. Thus, a multicolor image is generated from patterns of different primary colors or their subtractive compliments which are blended by the eye to create a visual perception of a color image.

This procedure of separating and superimposing color images produces so-called "process color" images, wherein each color separated image comprises an arrangement of picture elements, or pixels, corresponding to a spot to be developed with toner particles of a particular color. The multicolor image is a mosaic of different color pixels, wherein the color separations are laid down in the form of halftone dots. In halftone image processing, the dot densities of each of the color components making up the multicolor image can be altered to produce a large variation of color hues and shades. For example, lighter tints can be produced by reducing the dot densities such that a greater amount of white from the page surface remains uncovered to reflect light to the eye. Likewise, darker shades can be produced by increasing the dot densities. This method of generating process color images by overlapping halftones of different colors corresponding to the primary colors or their subtractive equivalents is well known in the art and will not be further described herein.

With the capabilities of electrostatographic technology moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing has been developed, wherein a printing system capable of producing process color output images is augmented with an additional developer housing containing an additional color beyond the primary or subtractive colors used to produce the process color output. This additional developer housing is used for developing an independent image with a specific color (spot color) or for extending the color gamut of the process color output (high fidelity color). As such, several concepts derived from conventional electrostatographic imaging techniques which were previously directed to monochrome and/or process color image formation have been modified to generate output images having selected areas that are different in color than the rest of the document. Applications of highlight color include, for example, emphasis on important information, accentuation of titles, and more generally, differentiation of specific areas of text or other image information.

One exemplary highlight color process is described in U.S. Pat. No. 4,078,929 to Gundlach, wherein independent images are created using a raster output scanner to form a tri-level image including a pair of image areas having different potential values and a non-image background area generally having a potential value intermediate the two image areas. As disclosed therein, the charge pattern is developed with toner particles of first and second colors, where the toner particles of one of the colors are positively charged and the toner particles of the other color are negatively charged, therefore producing a highlight color image.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of a customer selectable color output can be found in the field of "custom color", which specifically refers to registered proprietary colors, as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area. Further, lines and text produced by halftone process color are very sensitive to misregistration of the multiple color images such that blurring, color variances, and other image quality defects may result.

As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof. This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions to produce a customer selectable color output.

Customer selectable color printing materials including paints, printing inks and developing materials can be manufactured by determining precise amounts of constituent basic color components making up a given customer selectable color material, providing precisely measured amounts of each constituent basic color component, and thoroughly mixing these color components. This process is commonly facilitated by reference to a color guide or swatch book containing hundreds or even thousands of swatches illustrating different colors, wherein each color swatch is associated with a specific formulation of colorants. Probably the most popular of these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the Pantone® system or other color formula guides of this nature that cannot be produced via typical halftone process color methods or even by mixing selected amounts of cyan, magenta, yellow and/or black inks or developing materials.

In the typical operational environment, an electrostatographic printing system may be used to print various customer selectable color documents. To that end, replaceable containers of premixed customer selectable color developing materials corresponding to each customer selectable color are provided for each print job. Replacement of the premixed customer selectable color developing materials or substitution of another premixed color between different print jobs necessitates operator intervention which typically requires manual labor and downtime, among other undesirable requirements. In addition, since each customer selectable color is typically manufactured at an off-site location, supplies of each customer selectable color printing ink must be separately stored for each customer selectable color print job.

Previously referenced U.S. patent application Ser. No. 08/334,082, hereby incorporated by reference into the present application, discloses that it is desirable to provide an electrostatographic printing system with the capability of easily generating various customer selectable color output prints, in particular customer selectable color highlight color prints, wherein the developing material utilized to generate the customer selectable color output is formed of a mixture of at least two different basic color components provided in particular predetermined ratios. That patent application also discloses that it is desirable to provide an electrostatographic imaging process, wherein two or more color developing materials are dispensed from separate dispensers and are blended in a developing step for developing a latent with a developer material including a blend of two or more color toner compositions.

The patent literature is replete with control systems for controlling electrostatographic processing parameters in response to the quality of the image produced by means of maintaining a test image or patch. For example, it is now common practice to provide a scanning device to sense optical density on other characteristics of a development test patch in order to generate a control response signal to adjust machine operation for print quality. Public demand for increasing color quality and selectability has necessitated the development of various solutions and control mechanisms in response to particular requirements.

In a typical liquid developing material-based electrostatographic system, a liquid developing material reservoir is continuously replenished by the addition of various components making up the liquid developing material: namely liquid carrier, charge director, and a concentrated dispersion of toner particles in the carrier liquid, as necessary. This replenishment must be constantly monitored and controlled to provide a predetermined ratio and concentration of toner particles, liquid carrier, and charge director in the liquid developing material reservoir. The present invention builds on that concept by providing a system in which the color value of a developed customer selectable color image is monitored to control the rate of replenishment of various basic color components used to produce the customer selectable color developing material, thereby varying the concentration levels of each of the basic color components making up the customer selectable color developing material mixture in an operative developing material supply reservoir. Thus, the present invention contemplates a development system including a color mixing and control system, wherein the color value of the developing material in a supply reservoir can be controlled and the rate of replenishment of various color components added to the supply reservoir can be selectively varied. By adding and mixing precise amounts of specific developing materials from a set of basic color components, the actual color of the developing material in the reservoir is brought into agreement with a predetermined selected color. Moreover, by controlling the replenishment process accordingly, a wide range of customer selectable color developing materials can be produced and maintained over very long print runs.

U.S. Pat. No. 4,111,151 discloses an electrostatographic printing apparatus in which the developability of a development system comprising a mixture of particles having at least two different colors is regulated. The quantity of each of the different colored particles is maintained at a prescribed level to form a mixture of particles having a predetermined color. The mixture of particles is caused to pass between two light-transmissive plates, and light passing through the plates and through the particles is detected by three primary-color-filtered photosensors. Signals from the three photosensors are applied to an analog computer, which in turn controls motors which cause the dispensing of specific colored toner into a common toner supply. In this system the color of the mixture of particles is permanently fixed. The filters used to measure and control the mixture of particles is specific to the target color of the mixture of particles. This system does not provide a means of changing the color of the mixture of particles, for example from green in one print job to blue in a second job to orange in a third job.

U.S. Pat. No. 5,012,299 discloses a color adjustment apparatus for an electrostatographic printing machine. The apparatus includes a color chart for visually representing all real colors in terms of color elements of saturation and hue, which can be selected using a touch key. The selected colors, which are used to create highlight or spot colors on a printed image, are obtained by combining halftones of different primary color separations on a photoreceptor or intermediate drum; that is, in order to obtain selected colors by combining primary colorants, the colorants are printed sequentially onto a surface, instead of being combined as materials and printed as a solid layer. For the reasons described above, such process color approximations to a customer-selected color will show greater solid area color variations and greater line raggedness. And some customer-selected colors can not be as precisely matched by overlapping halftones as by a solid area printed with a mixture of primary colors.

U.S. Pat. No. 5,557,393 discloses an electrostatographic imaging process including the formation of an electrostatic latent image on an image forming device, developing the electrostatic latent image on the image forming device with at least one developer containing carrier particles and a blend of two of more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process.

U.S. Pat. No. 5,543,896 discloses a method for measurement of tone reproduction curves using a single structured patch for providing development control by storing a reference tone reproduction curve and providing a single test pattern including a scale of pixel values in an interdocument zone on a photoreceptor surface. The test pattern is sensed in the interdocument zone and a control response to the sensing of the test pattern is provided with reference to the tone reproduction curve in order to adjust the machine operation for print quality correction.

U.S. Pat. No. 5,369,476 discloses a toner control system and method for electrographic printing in which toner is delivered from a reservoir to a toner fountain for application to an electrostatically charged sheet to form an image. The visual quality of the image is monitored, and toner concentrate is added to the toner in response to the monitored quality to increase the amount of pigment particles in the toner and to thereby maintain a substantially constant image quality. In the disclosed embodiments, a test image is formed outside the main image on the sheet, and the brightness of one or more predetermined colors in the test image is monitored.

U.S. Pat. No. 5,240,806 discloses a liquid color toner composition for use in contact and gap electrostatic transfer processes, wherein the toner comprises a colored predispersion including: a non-polymeric resin material having certain insolubility (and non-swellability), melting point, and acid number characteristics; and alkoxylated alcohol having certain insolubility (and non-swellability) and melting point characteristics; and colorant material having certain particle size characteristics. The toner further comprises an aliphatic hydrocarbon liquid carrier having certain conductivity, dielectric constant, and flash point.

Xerox Disclosure Journal, Vol. 21, No. 2, pp. 155–157 discloses customer selectable color liquid ink development and a customer selectable color liquid ink development process wherein two or more liquid colored inks are applied simultaneously, in proper predetermined relative amounts, to provide custom or customer specified color images. The processes comprise, for example, providing a liquid development apparatus with at least one developer housing containing a liquid developer comprised of at least two different colored inks that are premixed at a desired concentration ratio, and developing a latent image with the premixed liquid developer to afford customer selectable colored developed images.

SUMMARY OF THE INVENTION

According to one aspect of the present invention, there is provided a method of determining the color of materials, each material comprising a subset of colorants from a selectable set of colorants. Light from the material is directed to a set of photodetectors, each photodetector being sensitive to a predetermined range of wavelengths. For a first material comprising a first subset of colorants, a set of signals from the set of photodetectors is converted to a set of proportions of each of the first subset of colorants in the first material, through a first set of weightings. For a second material comprising a second subset of colorants, a set of signals from the set of photodetectors is converted to a set of proportions of each of the second subset of colorants in the second material through a second set of weightings.

According to another aspect of the present invention, there is provided a method of determining the color of materials, each material comprising a subset of colorants from a selectable set of colorants. Light from the material is directed to a set of more than three photodetectors, each photodetector having a translucent filter associated therewith to make the photodetector sensitive to a predetermined range of wavelengths. A set of signals from the set of photodetectors is converted to a set of proportions of at least a subset of colorants in the material through a set of weightings.

According to another aspect of the present invention, there is provided an apparatus for providing a customer selectable color marking material in a printing machine, each color marking material containing a plurality of selectable colorants. A plurality of colorant supply receptacles is provided, each receptacle containing a different colorant corresponding to a basic color component of a color matching system. A colorant reservoir has at least one of the plurality of colorant supply receptacles coupled thereto, for providing a supply of marking material having the specified color value. A sensing device includes means for directing light from the color marking material to a set of photodetectors, each photodetector being sensitive to a predetermined range of wavelengths. Means are provided for converting a set of signals from the set of photodetectors to a set of proportions of each of a first subset of colorants in a first color marking material through a first set of weightings, and converting a set of signals from the set of photodetectors to a set of proportions of each of a second subset of colorants in a second color marking material through a second set of weightings.

According to another aspect of the present invention, there is provided an apparatus for providing a customer selectable color marking material in a printing machine, each color marking material containing a plurality of selectable colorants. A plurality of colorant supply receptacles are provided, each containing a different colorant corresponding to a basic color component of a color matching system. A colorant reservoir includes at least one of the plurality of colorants supply receptacles coupled thereto, for providing a supply of marking material having a specified color value. A sensing device includes a set of more than three photodetectors for receiving light from the color marking material, each photodetector having a translucent filter associated therewith to make the photodetector sensitive to a predetermined range of wavelengths. The sensing device further includes means for converting a set of signals from the set of photodetectors to a set of proportions of each of at least a subset of colorants in the color marking material through a set of weightings.

DETAILED DESCRIPTION OF THE INVENTION

Figure 1:
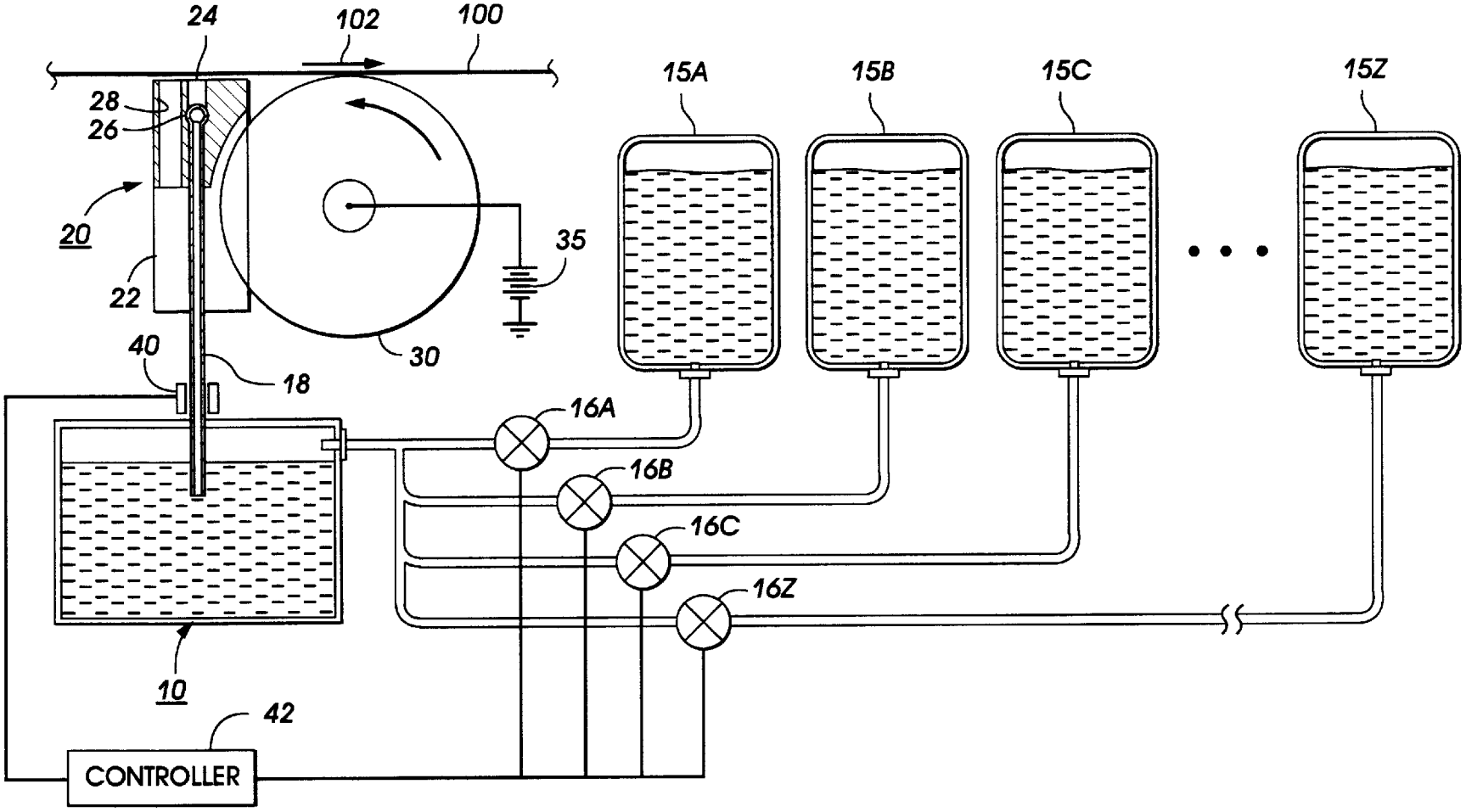
FIG. 1 is a simplified elevational view of a liquid-based electrostatographic printing apparatus, as would incorporate the system of the present invention.

Since the art of electrostatographic printing is well known, it is noted that several concepts for electrostatographic highlight, spot and/or high fidelity color imaging systems which could make beneficial use of the color mixing and control system of the present invention have been disclosed in the relevant patent literature. One of the more elegant and practical of these concepts is directed toward single-pass highlight color tri-level imaging. In general, tri-level imaging involves the creation of two different electrostatic latent images at different voltage levels generated in a single imaging step, with a background or non-image area at yet another intermediate voltage level. Typically, one latent image is developed using charged-area development (CAD) techniques, while the other is developed via discharged-area development (DAD) techniques. This is accomplished by using positively charged toner for one color and negatively charged developing materials for the other, in separate housings. For example, by providing one developing material in black and the other in a selected color for highlighting, two different color images can be created on a single output document in a single processing cycle. This concept for tri-level xerography, is disclosed in U.S. Pat. No. 4,078,929, issued in the name of Gundlach, incorporated by reference herein. As disclosed therein, tri-level xerography involves the modification of known xerographic processes, such that the xerographic contrast on the charge retentive surface or photoreceptor is divided three ways, rather than two, as in the case in conventional xerography. Thus the photoreceptor is imagewise exposed such that one image, corresponding to charged image areas, is maintained at the full photoreceptor potential ($V_{ddp}$ or $V_{cad}$) while the other image, which corresponds to discharged image areas is exposed to discharge the photoreceptor to its residual potential, i.e. $V_c$ or $V_{dad}$. The background areas are formed by exposing areas of the photoreceptor at $V_{ddp}$ to reduce the photoreceptor potential to halfway between the $V_{cad}$ and $V_{dad}$ potentials, and is referred to as $V_w$ or $V_{white}$.

While the present invention may find particular application in tri-level highlight color imaging, it will become apparent from the following discussion that the color mixing and control system of the present invention may be equally well-suited for use in a wide variety of printing machines and is not necessarily limited in its application to the particular single-pass highlight tri-level electrostatographic process described by Gundlach. In fact, it is intended that the color mixing and control system of the present invention may be extended to any electrostatographic printing process intended to produce a customer selectable color image area including multi-color printing machines which may be provided with an ancillary customer selectable color development housing, as well as printing machines which carry out ionographic printing processes and the like. More generally, while the color mixing and control system of the present invention will hereinafter be described in connection with a preferred embodiment thereof, it will be understood that the description of the invention is not intended to limit the scope of the present invention to this preferred embodiment. On the contrary, the present invention is intended to cover all alternatives, modifications, and equivalents as may be included within the spirit and scope of the invention as defined by the appended claims.

Turning now to FIG. 1, an exemplary apparatus for developing an electrostatic latent image, wherein liquid developing materials are utilized is depicted in schematic form. Typically, a highlight color electrostatographic printing machine would include at least two developing apparatus operating with different color liquid developing materials for developing latent image areas into different colored visible images. By way of example, in a tri-level system of the type described hereinabove, a first developer apparatus might be utilized to develop the positively charged image area with black colored liquid developing material, while a second developer apparatus might be used to develop the negatively charged image area image with a customized color. In the case of liquid developing materials, each different color developing material comprises pigmented toner or marking particles, as well as charge control additives and charge directors, all disseminated through a liquid carrier, wherein the marking particles are charged to a polarity opposite in polarity to the charged latent image to be developed.

The developing apparatus of FIG. 1 operates primarily to transport liquid developer material into contact with a latent image on a photoreceptor surface, generally identified by reference numeral 100, wherein the marking particles are attracted, via electrophoresis, to the electrostatic latent image for creating a visible developed image thereof. With respect to the developing material transport and application process, the basic manner of operation of each developer apparatus is generally identical to one another and the developing apparatus shown in FIG. 1 represents only one of various known apparatus that can be utilized to apply liquid developing material to the photoconductive surface. It will be understood that the basic development system incorporating the mixing and control system of the present invention may be directed to either liquid or dry powder development and may take many forms, as for example, systems described in U.S. Pat. Nos. 3,357,402; 3,618,552; 4,733,273; 4,883,018; 5,270,782 and 5,355,201 among numerous others. Such development systems may be utilized in a multicolor electrophotographic printing machine, a highlight color machine, or in a monochromatic printing machine. In general, the only distinction between each developer unit is the color of the liquid developing material therein. It will be recognized, however, that only developer applicators which require the capability of generating customer selectable color outputs will be provided with the customer selectable color mixing and control system of the present invention.

Focusing on the development process before describing the color mixing and control system of the present invention, in the exemplary developing apparatus of FIG. 1, liquid developing material is transported from an supply reservoir 10 to the latent image on the photoreceptor 100 via a liquid developing material applicator 20. Supply reservoir 10 acts as a holding receptacle for providing an operative solution of liquid developing material comprised of liquid carrier, a charge director compound, and toner material, which, in the case of the customer selectable color application of the present invention, includes a blend of different colored marking particles. In accordance with the present invention, a plurality of replaceable supply dispensers 15A–15Z, each containing a concentrated supply of marking particles and carrier liquid corresponding to a basic color component in a color matching system, are provided in association with the operational supply reservoir 10 and coupled thereto for replenishing the liquid developing material therein, as will be described.

The exemplary developing material applicator 20 includes a housing 22, having an elongated aperture 24 extending along a longitudinal axis thereof so as to be oriented substantially transverse to the surface of photoreceptor 100, along the direction of travel thereof, as indicated by arrow 102. The aperture 24 is coupled to an inlet port 26 which is further coupled to reservoir 10 via transport conduit 18. Transport conduit 18 operates in conjunction with aperture 24 to provide a path of travel for liquid developing material being transported from reservoir 10 and also defines a developing material application region in which the liquid developing material can freely flow in order to contact the surface of the photoreceptor belt 100 for developing the latent image thereon. Thus, liquid developing material is pumped or otherwise transported from the supply reservoir 10 to the applicator 20 through at least one inlet port 26, such that the liquid developing material flows out of the elongated aperture 24 and into contact with the surface of photoreceptor belt 100. An overflow drainage channel (not shown), partially surrounds the aperture 24, may also be provided for collecting excess developing material which may not be transferred over to the photoreceptor surface during development. Such an overflow channel would be connected to an outlet channel 28 for removal of excess or extraneous liquid developing material and, preferably, for directing this excess material back to reservoir 10 or to a waste sump whereat the liquid developing material can preferably be collected and the individual components thereof can be recycled for subsequent use.

Slightly downstream of and adjacent to the developing material applicator 20, in the direction of movement of the photoreceptor surface 100, is an electrically biased developer roller 30, the peripheral surface thereof being situated in close proximity to the surface of the photoreceptor 100. The developer roller 30 rotates in a direction opposite the movement of the photoconductor surface 100 so as to apply a substantial shear force to the thin layer of liquid developing material present in the area of the nip between the developer roller 30 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 20. The excess developing material eventually falls away from the rotating metering roll for collection in the reservoir 10 or a waste sump (not shown). A DC power supply 35 is also provided for maintaining an electrical bias on the metering roll 30 at a selected polarity and magnitude such that image areas of the electrostatic latent image on the photoconductive surface will attract marking particles from the developing material for developing the electrostatic latent image. This electrophoretic development process minimizes the existence of marking particles in background regions and maximizes the deposit of marking particles in image areas on the photoreceptor.

In operation, liquid developing material is transported in the direction of the photoreceptor 100, filling the gap between the surface of the photoreceptor and the liquid developing material applicator 20. As the belt 100 moves in the direction of arrow 102, a portion of the liquid developing material in contact with the photoreceptor moves therewith toward the developing roll 30 where marking particles in the liquid developer material are attracted to the electrostatic latent image areas on the photoreceptor. The developing roller 30 also meters a predetermined amount of liquid developing material adhering to the photoconductive surface of belt 100 and acts as a seal for preventing extraneous liquid developing material from being carried away by the photoreceptor.

As previously indicated, the liquid developing materials of the type suitable for electrostatographic printing applications generally comprise marking particles and charge directors dispersed in a liquid carrier medium, with an operative solution of the developing material being stored in reservoir 10. Generally, the liquid carrier medium is present in a large amount in the liquid developing material composition, and constitutes that percentage by weight of the developer not accounted for by the other components. The liquid medium is usually present in an amount of from about 80 to about 99.5 percent by weight, although this amount may vary from this range provided that the objectives of the present invention can be achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, and environmentally safe.

The marking or so-called toner particles of the liquid developing material can comprise any particle material compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in the operative liquid developing material in amounts of from about 0.5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone. Other compounds including charge control additives may be optionally included.

Examples of thermoplastic resins include ethylene vinyl acetate (EVA) copolymers, (ELVAX® resins, E. I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURALÔ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an a-b-ethylenically unsaturated acid of either acrylic acid or methacrylic acid. In a preferred embodiment, NUCREL® resins available from E. I. DuPont de Nemours and Company like NUCREL 599®, NUCREL 699®, or NUCREL 960® are selected as the thermoplastic resin.

In embodiments, the marking particles are comprised of thermoplastic resin, a charge adjuvant, and the pigment, dye or other colorant. Therefore, it is important that the thermoplastic resin and the charge adjuvant be sufficiently compatible that they do not form separate particles, and that the charge adjuvant be insoluble in the hydrocarbon liquid carrier to the extent that no more than 0.1 weight percent be soluble therein. Any suitable charge director, such as, for example, a mixture of phosphate ester and aluminum complex can be selected for the liquid developers in various effective amounts, such as, for example, in embodiments from about 1 to 1,000 milligrams of charge director per gram of toner solids and preferably 10 to 100 milligrams/gram. Developer solids include toner resin, pigment, and optional charge adjuvant.

Liquid developing materials preferably contain a colorant dispersed in the resin particles. Colorants, such as pigments or dyes like black, white, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible. The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Clear, unpigmented developing materials may also be used to lighten the printed images. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK®, PV FAST BLUE®, Titanium Dioxide (white) and Paliotol Yellow D1155; as well as the numerous pigments listed and illustrated in U.S. Pat. Nos. 5,223,368; 5,484,670, the disclosures of which is totally incorporated herein by reference.

As previously discussed, in addition to the liquid carrier vehicle and toner particles which typically make up the liquid developer materials, a charge director compound (sometimes referred to as a charge control additive) is also provided for facilitating and maintaining a uniform charge on the marking particles in the operative solution of the liquid developing material by imparting an electrical charge of selected polarity (positive or negative) to the marking particles.

Examples of suitable charge director compounds and charge control additives include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The use of quaternary charge directors as disclosed in the patent literature may also be desirable. The charge control additive may be present in an amount of from about 0.01 to about 3 percent by weight, and preferably from about 0.02 to about 0.20 percent solids by weight of the developer composition.

The application of developing material to the photoconductive surface clearly depletes the overall amount of the operative solution of developing material in supply reservoir 10. In the case of the liquid developing materials, marking particles are depleted in the image areas; carrier liquid is depleted in the image areas (trapped by marking particles) and in background areas, and may also be depleted by evaporation; and charge director is depleted in the image areas (trapped in the carrier liquid), in the image areas adsorbed onto marking particles, and in the background areas. In general practice, therefore, reservoir 10 is continuously replenished, as necessary, by the addition of developing material or selective components thereof, for example in the case of liquid developing materials, by the addition of liquid carrier, marking particles, and/or charge director into the supply reservoir 10. Since the total amount of any one component making up the developing material utilized to develop the image may vary as a function of the area of the developed image areas and the background portions of the latent image on the photoconductive surface, the specific amount of each component of the liquid developing material which must be added to the supply reservoir 10 varies with each development cycle. For example, a developed image having a large proportion of printed image area will cause a greater depletion of marking particles and/or charge director from a developing material reservoir as compared to a developed image with a small amount of printed image area.

Thus, it is known in the art that, while the rate of the replenishment of the liquid carrier component of the liquid developing material may be controlled by simply monitoring the level of liquid developer in the supply reservoir 10, the rate of replenishment of the marking particles, and/or the charge director components of the liquid developing material in reservoir 10 must be controlled in a more sophisticated manner to maintain the correct predetermined concentration for proper functionality of the marking particles and the charge director in the operative solution stored in the supply reservoir 10 (although the concentration may vary with time due to changes in operational parameters). Systems have been disclosed in the patent literature and otherwise for systematically replenishing individual components making up the liquid developing material (liquid carrier, marking particles and/or charge director) as they are depleted from the reservoir 10 during the development process. See, for example, commonly assigned U.S. patent application Ser. No. 08/551,381 and the references cited therein.

The present invention, however, contemplates a developing material replenishing system capable of systematically replenishing individual color components making up a customer selectable color developing material composition. As such, the replenishment system of the present invention includes a plurality of differently colored concentrate supply dispensers 15A, 15B, 15C, . . . 15Z, at least a pair of which are coupled to the operative supply reservoir via an associated valve member 16A, 16B 16C, . . . 16Z, or other appropriate supply control device. Preferably, each supply dispenser contains a developing material concentrate of a known basic or primary color component used in a given color matching system. It will be understood that each of the plurality of supply dispensers 15A–15Z may be coupled to the reservoir, or only selected supply dispensers may be coupled to the reservoir 10. For example, under certain circumstances, such as space constraints or cost restraints, it may be desirable to use only dispensers 15A, 15B and 15C, making up a simplified color matching system.

In one specific embodiment, the replenishment system includes sixteen supply dispensers, wherein each supply dispenser provides a different basic color developing material corresponding to the sixteen basic or constituent colors of the Pantone® Color Matching System such that color formulations conveniently provided thereby can be utilized to produce over a thousand desirable colors and shades in a customer selectable color printing environment. Using this system, as few as two different color developing materials, from supply containers 15A and 15B for example, can be combined in reservoir 10 to expand the color gamut of customer selectable colors far beyond the colors available via halftone imaging techniques or even the colors available from mixing just Yellow, Magenta, Cyan and Black colored developing materials.

An essential component of the developing material color mixing and control of the present invention is a mixing control system. That is, since different components of the blended or mixed developing material in reservoir 10 may develop at different rates, a customer selectable color mixing controller 42 is provided in order to determine appropriate amounts of each color developing material in supply containers 15A, 15B . . . or 15Z which may need to be added to supply reservoir 10, and to controllably supply each of such appropriate amounts of developing material. Controller 42 may take the form of any known microprocessor based memory and processing device as are well known in the art.

The approach provided by the color mixing control system of the present invention includes a sensing device 40, for example an optical sensor for monitoring the color of the liquid developing material in the reservoir 10. It will be appreciated that although a spectrophotometric approach to color sensing may provide extremely rigorous color measurements, the high cost and computational demands may yield advantages to more basic technology. Thus, while sensor 40 can take various forms and could be of many types as are well known in the art, the preferred embodiment of the present invention includes a filter series for sensing the color of the developing material delivered out of the developing material reservoir 10 to the developing material applicator 20. The filter series contemplated by the present invention is represented diagramatically in FIG. 1 as sensing device 40, situated so as to sense the liquid developing material being transported from the liquid developing material reservoir 10 to the developing material applicator 20. It will be understood by those of skill in the art that various multi-wavelength filter devices may be utilized to detect the color of the developing material including devices which are submerged in the liquid developing material reservoir 10, or devices which monitor the light attenuation across the entire volume of the reservoir 10.

Sensor 40 is connected to controller 42 for controlling the flow of the variously colored replenishing liquid developing materials from dispensers 15A–15Z, corresponding to the basic constituent colors of a color matching system, to be delivered into the liquid developing material supply reservoir 10 from each of the supply containers 15A–15Z. In a preferred embodiment, as shown in FIG. 1, the controller 42 is coupled to control valves 16A–16Z for selective actuation thereof to control the flow of liquid developing material from each supply container 15A–15Z. It will be understood that these valves may be replaced by pump devices or any other suitable flow control mechanisms as known in the art, so as to be substituted thereby.

As previously noted, in accordance with the present invention, sensor 40 includes a filter series. As such, sensor 40 includes a suitable lamp, filters and a photodetector, wherein light is transmitted from the lamp through the filters and onto the developing material. The reflectance, transmission, or emission of the developing material as it is illuminated, in turn by the light passing through each filter. In a well recognized approach, a predetermined number of relatively narrow bandwidth filters having transmittance peaks distributed across the visible spectrum are utilized to determine the spectral distribution of a test sample, in this case, the developing material being sensed. By using a sufficient number of filters having filter transmittances which are confined to sufficiently narrow wavelengths, discernible spectral power distribution can be provided by the filter series so as to distinguish basic color components making up the developing material so as to define the color thereof.

The spectral distribution information can also be used to define the color of the developing materials in terms of a particular color coordinate system, such as, for example, the well recognized standardized color notation system for defining uniform color spaces developed by the Commission Internationale de l'Eclairage (CIE). The CIE color specification system employs so called "tristimulus values" to specify colors and to establish device independent color spaces. The CIE standards are widely accepted because measured colors can be readily expressed in the CIE recommended coordinate systems through the use of relatively straight-forward mathematical transformations.

Once the color for the monitored developing material is determined, the color of the measured sample, as may be defined by the spectral distribution or tristimulus values, among other units of measurement, is compared to the known values corresponding to the desired output color (as may be provided by the color matching system) to determine the precise color formulation necessary in the supply of operative developing material to yield a correct color match. This information is processed by controller 42 for selectively actuating valves 16A–16Z to systematically dispense to the reservoir 10 selective amounts of developing material concentrate corresponding to selected basic color components from selected supply dispensers 15A–15Z.

In sum, sensor 40 is provided in the form of a series of filter elements in combination with a light source and light detector for providing measurements that can be utilized to provide color mixing control. Measurements obtained from the filter series are compared to a priori knowledge of like optical properties of the basic color components making up the customer selectable color developing material to provide an estimate of the concentration levels of each color component in the reservoir as well as the correction necessary to obtain target concentration levels yielding the desired customer selectable color output. Thus, the filter series provides a measurement of selected optical properties of the blended developing material in the reservoir 10, wherein this optical property information is subsequently transmitted to the controller 42, which compares the measured optical property information to corresponding known optical property values of the desired output color, as may be stored in a look up table or the like of a memory device. This information is used to determine the appropriate amounts of each color component which should be added to the reservoir 10 via actuation of valves 16A–16Z, respectively.

Figure 2:
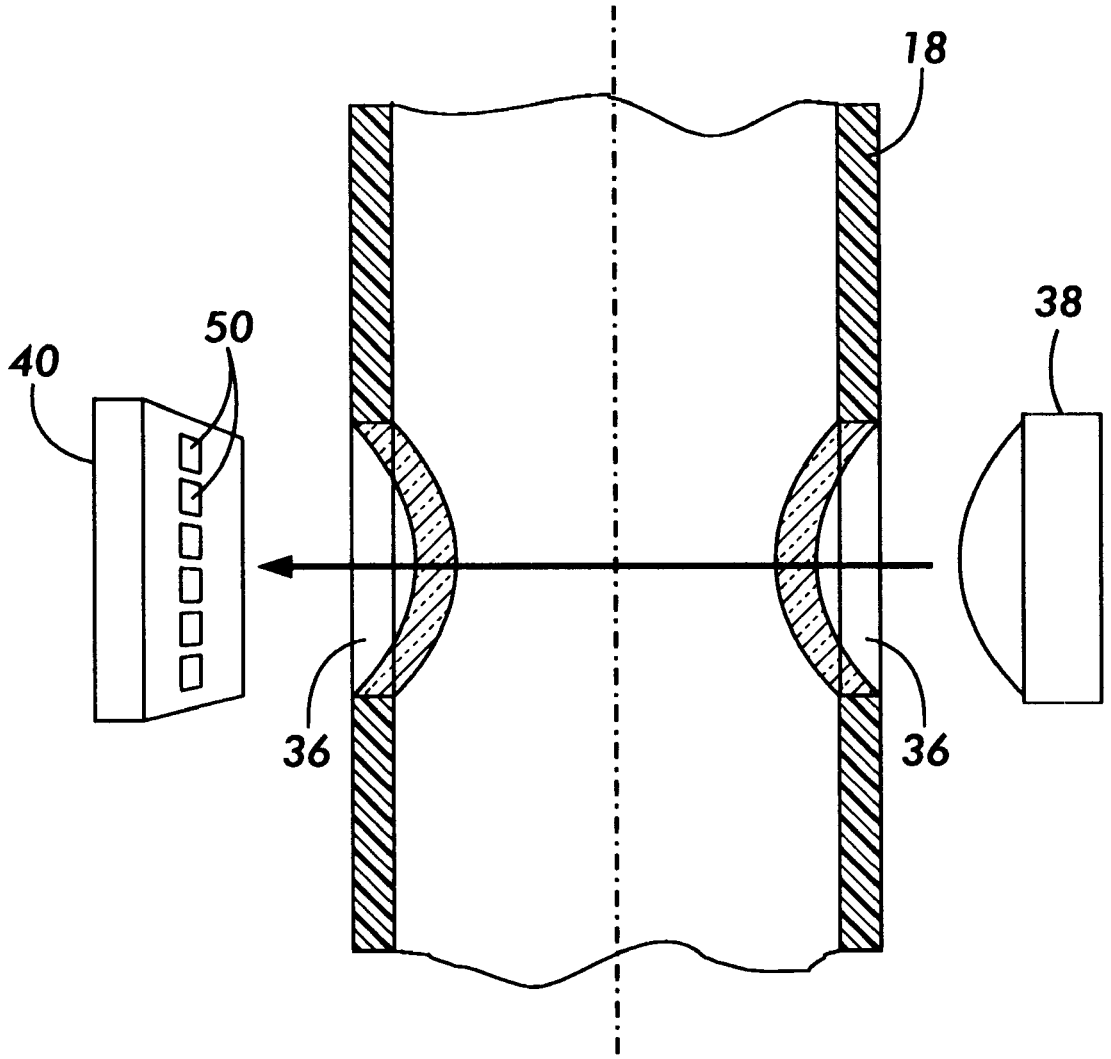
FIG. 2 is a simplified elevational view showing in detail a portion of the apparatus shown in FIG. 1, where light received from a mixture of colorants obtained within the printing apparatus is analyzed.

FIG. 2 is a simplified view showing in detail the interaction of sensor 40 with transport conduit 18, as described above. In a preferred embodiment of the present invention, a portion of conduit 18 having what is intended to be the desired mixture of colorants passing therethrough is provided with two windows, or substantially light-transmissive areas shown in FIG. 2 as 36. A light source 38 causes light to pass through the two windows 36 and through a cross-section of the conduit 18, whereby the light from light source 38 transmits through the colorant mixture passing through the transfer conduit 18. The light passing through the colorant mixture passes through both windows 36 and impinges on each photodetector 50 on sensor 40.

Each individual photodetector 50 on sensor 40 is provided with a translucent filter (not shown) thereon, so that only light of a specific range of wavelengths passes therethrough. In a preferred embodiment of the present invention, there are provided six individual photosensors 50 on sensor 40, each provided with a different translucent filter thereon, as will be described in detail below. It will be understood that a translucent filter such as placed on each individual photodetector 50 is typically a chemical filter forming a translucent coating over the particular photodetector 50, and typical materials for such a filter include polyimide or acrylic. Also to be considered "translucent" filters are interference filters.

According to another possible embodiment of the invention, the sensor 40 could include only one photodetector, with a set of filters selectably disposable over the photodetector, such as on a wheel, to filter a particular color relative to the photodetector at a particular time. The different color signals from the single photodetector could then be tested in sequence. Such an arrangement should be deemed an equivalent to the multi-photodetector arrangement as described and recited in the claims. Further, although the illustrated embodiment shows a system whereby light transmitted through the mixture of colorants is directed to the sensor 40; however, an equivalent arrangement could be provided in which the light reflected from the colorants is directed to sensor 40. Whether the overall system relies on light transmitted through or reflected from the mixture of colorants may depend on factors such as the proportion of solids in the colorants, or whether the colorant mixture is placed on a substrate (such as, for example, if the colorant mixture is obtained by developing the mixture onto a photoreceptor or tranmsferring the developed mixture onto a substrate, such as a sheet of paper).

According to the present invention, there should be more than three different-wavelength-filtered photosensors 50 on sensor 40; in a practical embodiment, six photosensors 50 yielded satisfactory results. The sensor 40 having differently-filtered photodetectors 50 could be adapted from a CCD or CMOS-based color photosensor imaging chip of a basic chip design known in the art, by associating filters to different photosensors on the chip in novel ways. By virtue of their center wavelengths and widths, the filters should together filter ranges of light from, in effect, a contiguous range of wavelengths, and this range preferably should span the visible spectrum. There may further be provided, between transport conduit 18 and the photodetectors 50 of sensor 40, any number of optical elements (not shown) which could focus or otherwise direct the light from light source 38 passing through the colorant mixture to the sensors 50; in a practical embodiment of the present invention such an optical element would typically include a quantity of fiber optic cable.

According to the present invention, signals derived from a relatively small (such as six) number of photosensors receiving light passing through the colorant mixture can be used to derive an accurate set of color measurements from which the precise color properties of the colorant mixture can be determined at any time. In the prior art, in order to obtain a color-measuring system of the typically desired accuracy and precision, there would typically be required, instead of the relatively simple sensor 40, a spectrophotometer. While a spectrophotometer could obtain a precise profile of the distribution of wavelengths in a sample of light, the spectrophotometer works on the principle of physically separating, such as by means of a prism or equivalent, individual primary colors from the light and then directing the separated colors to one or more substantially unfiltered photodetectors. In contrast, with the present invention, there is provided a relatively small number of photodetectors, each photodetector 50 having thereon a relatively inexpensive translucent filter thereon.

One method of carrying out the color mixing control process provided by the present invention will be described as follows. Initially, light passing through each filter is detected by a photodetector 50, producing a set of N filter signals, identified as $f_n$, corresponding to the number of filter elements, identified by the variable N. Assuming there are i developing material compositions (colorants) corresponding to a number of basic color components utilized to produce the customer selectable color developing material, the composition of each color component making up the developing material passing through the filter, identified as $w_i$, can be calculated from the filter responses $f_n$, represented as follows:

$$\{w_i\}=F(\{f_n\})$$

One method of performing this calculation uses a previously determined matrix, $A_{ni}$:

$$w_i=\Sigma_n A_{ni} f_n$$

In general, there will be a unique value, or "weighting," $A_{ni}$ for every combination of filter n and colorant i; one could thus construct an n x i matrix of values of weightings $A_{ni}$ for a set of colorants and filters. The $A_{ni}$ are related in principle to the absorption spectra of the developing material components and to the transmission spectra of the filters. However, the $A_{ni}$ can be most usefully obtained by fitting the filter signals from a known set of mixed developing materials. The accuracy of each $w_i$ can be improved by using knowledge of which components are added to the mixed developing material.

In a first method by which this invention can be practiced, a set of filters on photodetectors 50 is used which is equal to the total number of colorants or basic color components from which all customer selectable colors will be mixed. The transmission of light through each component and each filter is measured and the resulting matrix is inverted to obtain a matrix of weightings $A_{ni}$ for each combination of filter n and colorant i.

In a second method by which this invention can be practiced, a set of filters is used which need not be equal to the total number of colrants from which all customer selectable colors will be mixed. Filter responses of a large set of mixed toners are measured and $A_{ni}$ is obtained by minimizing the RMS error between known and estimated concentrations, $W_{ik}$, for the ith component of the kth mixture.

In a third method by which this invention can be practiced, a set of filter responses and a set of known concentrations for a large set of mixed toners is used to train a neural net. The matrix multiplication defined above is replaced by a neural net calculation:

$$\{w_i\}=NN(\{f_n\})$$

where the braces denote that a set of filter functions is input to the neural net and a set of weights is output.

In a fourth method by which this invention can be practiced, a set of filters is used which need not be equal to the total number of primaries or basic color components from which all customer selectable colors will be mixed. In this method, filter responses of a large set of mixed developing materials are measured. Different sets of $A_{ni}$ are obtained for different subsets of colorants from the full set of colorants, the subsets being mixed combinations of primary component colorants. For example, a set of $A_{ni}$ is obtained for each unique subset of primary developing materials, such as Yellow and Red; Yellow and Blue; Blue and Red; Yellow, Blue and Red; etc. Again, each set of $A_{ni}$ is obtained by minimizing the RMS error between known and estimated concentrations, $W_{ik}$, for the ith component of the kth mixture in the set. With this technique, instead of using a single large matrix of weightings $A_{ni}$ relating every combination of filter n and available colorant i in a large set of available colorants, there thus results a plurality of smaller matrices, each small matrix including weightings relating each filter n to a subset (such as two) of colorants. If it is thus known in advance that, for example, only blue and yellow colorants would be in the mixture, the small matrix relating the photosensor outputs to yellow and blue only (for an n×2 matrix) is all that is necessary; if it is known that only blue and red colorants are in the mixture, a different small matrix is used. In the context of the printing apparatus of FIG. 1, it will probably be known in advance which subset of colorants from supply dispensers 15A, 15B, 15C, . . . 15Z are in conduit 18 at a given time. These smaller matrices not only save computing time in a real-time control system, but are likely to yield more accurate results than a single large matrix which tries to take into account every possible colorant. Also, as a practical matter, it is possible that a single particular weighting $A_{ni}$ relating one filter n to one colorant i may have a different value in a different small matrix: for instance a specific value of $A_{ni}$ relating a 570 nm filter to yellow colorant may be different in a yellow and blue small matrix, in a yellow and red small matrix, and in a large matrix taking into account the set of all available colorants.

The performance of some of the above disclosed processes have been tested by modeling methods. For example, a set of six colorants, namely in colors similar to: Pantone's Yellow; Warm Red; Rubine Red; Reflex Blue; Process Blue; and Green, has been estimated will reproduce about 75% of the Pantone customer selectable colors. Transmission spectra for 70 mixtures of these primaries were calculated, wherein each mixed developing material has total solids of 1wt % and 2–3 basic color components (i.e., subsets of colorants). Component concentrations differ from one mixture to the next by amounts as small as 0.01 wt %. Filter responses for idealized sets of Gaussian filters were also calculated, where each filter is specified by its center wavelength and its full width at half maximum transmission.

In one modeling example, using six 25 nm wide filters, centered at 425, 475, 525, 575, 625, and 675 nm, respectively, it was found that the direct method of calculating component concentrations is only approximate and may yield non-zero concentration measurements for some basic color components which are not necessarily present in a given mixture, as well as some negative estimated concentrations. (In the claims below, reference is made to "proportions" of various colorants in a material being tested; this term shall include any measurement of a quantity of colorant, such as solid weight, chemical concentration of liquid in liquid or solid in liquid, etc.) These erroneous calculations can be roughly corrected by substituting zero for all negative estimated concentrations and by using knowledge of the mixtures to force estimated concentrations of unused components to zero such that the RMS error in estimated concentrations can be substantially corrected. The RMS error in the individual component concentrations was about 0.36 wt %. Adjusting the filter positions and widths appropriately, an improved set of filters was determined as follows:

| center (nm) | 400 | 430 | 510 | 570 | 630 | 700 |
|---|---|---|---|---|---|---|
| width (nm) | 25 | 25 | 25 | 25 | 50 | 10 |

These new filters yielded an RMS error of 0.20 wt %. Of course, further optimization of the filter set may reduce the RMS error even further. However, these estimates may be sufficiently accurate for crude color control and may suffice for some applications.

With regard to the above table of properties of different filters which are placed on photodetectors 50, the "width" mentioned above refers to the general behavior of the Gaussian distribution of color sensitivities of a particular photodetector 50 having a particular translucent filter thereon. In brief, in the illustrated embodiment of the present invention, the "width" associated with a particular filter having a center value of passing a particular wavelength, the width is the distance from the center, in nm, at which one-half of the intensity of the passing light at the center value is received. Thus, for a filter having a center of 400 nm and a width of 25 nm, light at 425 nm or 375 nm will cause a signal to be output from the photodetector 50 at one-half of the intensity of light of 400 nm impinging on the photodetector 50.

In another example, the first set of six filters above was used to empirically adjust the $A_{ni}$, resulting in a reduction of the RMS error to approximately 0.067 wt %. In a similar manner, an empirical adjustment of the $A_{ni}$ corresponding to the second filter set reduced the RMS error to 0.040 wt %, thus providing much more accurate color control than the first method.

In another experiment the test set of 70 mixtures was broken into subsets, each subset made of 2–3 primary developing materials. For each mixture subset, only the first filter set was utilized and a set of $A_{ni}$ was empirically optimized, where i relates only to the primaries used in the mixture subset. For 13 mixtures of Yellow and Warm Red in the test set, empirical optimization of the 2×6 $A_{ni}$ matrix reduced the RMS error to 0.001 wt %. For 8 mixtures of Yellow and Rubine Red in the test set, empirical optimization of the 2'6 $A_{ni}$ matrix reduced the RMS error to 0.001 wt %. For 6 mixtures of Warm Red and Rubine Red in the test set, empirical optimization of the 2×6 $A_{ni}$ matrix reduced the RMS error to less than 0.001 wt %. Since the test set contains only 3 mixtures of Yellow, Rubine Red, and Process Blue, the set was supplemented with three additional mixtures spanning a larger range of component compositions than the mixtures in the original test set. The resultant empirical optimization of the 3×6 $A_{ni}$ matrix reduced the RMS error to 0.006 wt %. In addition, for 7 mixtures of Process Blue and Green in the test set, empirical optimization of the 2×6 $A_{ni}$ matrix reduced the RMS error to 0.001 wt %. In all these cases, it was found that the accuracy of component concentration estimates is great enough to clearly distinguish all the colors in the test set for the color control system.

It will be understood that the foregoing methods represent a only a few of the numerous and various processes that could be implemented for controlling the mixture of color components using a series of filters in order to provide a specified color output.

In review, the present invention provides a system and method for color mixing control in an electrostatographic printing system. A developing reservoir containing an operative solution of customer selectable colored developing material is continuously replenished with the color thereof being controlled and maintained by selectively varying the rate of replenishment of various color components added to the supply reservoir. A series of filter elements is used to measure the optical properties of the developing material in the supply reservoir so that the corresponding optical properties thereof can be brought into agreement with corresponding target optical properties. The present invention can be used to control and maintain the color of the developing material in the reservoir through continuous monitoring and correction thereof in order to maintain a particular ratio of color components in the reservoir over extended periods associated with very long print runs. The present invention may also be utilized to mix a customer selectable color in situ, whereby approximate amounts of primary color components are initially deposited and mixed in the developing material reservoir, this developing material mixture being continually monitored and adjusted until the mixture reaches a some predetermined target optical properties.

It is, therefore, evident that there has been provided, in accordance with the present invention a color mixing control and replenishment system that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A method of determining the color of materials, each material comprising a subset of colorants from a selectable set of colorants, comprising the steps of:

directing light from the material to a set of photodetectors, each photodetector being sensitive to a predetermined range of wavelength;

for a first material comprising a first subset of colorants, converting a set of signals from the set of photodetectors to a set of proportions of each of the first subset of colorants in the first material through a first set of weightings; and for a second material comprising a second subset of colorants, converting a set of signals from the set of photodetectors to a set of proportions of each of the second subset of colorants in the second material through a second set of weightings.

2. The method of claim 1, wherein the set of photodetectors comprises more than three photodetectors.

3. The method of claim 1, wherein each photodetector includes a translucent filter associated therewith.

4. The method of claim 1, wherein the ranges of wavelengths to which the set of photodetectors is sensitive spans a substantially contiguous range of wavelengths.

5. The method of claim 4, wherein the ranges of wavelengths to which the set of photodetectors is sensitive spans substantially the spectrum of visible light.

6. The method of claim 1, wherein the step of converting a set of signals from the set of photodetectors to a set of proportions of each of the first subset of colorants in the first material through a first set of weightings comprises applying the set of signals to a neural network.

7. The method of claim 1, wherein a weighting $A_{ni}$ relating a signal from one photosensor filtered at wavelength n to a colorant i in the first set of weightings is different from a weighting $A_{ni}$ relating a signal from the photosensor filtered at wavelength n to the colorant i in the second set of weightings.

8. A method of determining the color of materials, each material comprising a subset of colorants from a selectable set of colorants, comprising the steps of:

directing light from the material to a set of more than three photodetectors, each photodetector having a translucent filter associated therewith to make the photodetector sensitive to a predetermined range of wavelength;

converting a set of signals from the set of photodetectors to a set of proportions of each of at least a subset of colorants in the material through a set of weightings.

9. The method of claim 8, the converting step including the steps of for a first material comprising a first subset of colorants, converting a set of signals from the set of photodetectors to a set of proportions of each of the first subset of colorants in the first material through a first unique set of weightings; and for a second material comprising a second subset of colorants, converting a set of signals from the set of photodetectors to a set of proportions of each of the second subset of colorants in the second material through a second unique set of weightings.

10. The method of claim 9, wherein a weighting $A_{ni}$ relating a signal from one photosensor filtered at wavelength n to a colorant i in the first set of weightings is different from a weighting $A_{ni}$ relating a signal from the photosensor filtered at wavelength n to the colorant i in the second set of weightings.

11. The method of claim 8, wherein the ranges of wavelengths to which the set of photodetectors is sensitive spans a substantially contiguous range of wavelengths.

12. The method of claim 11, wherein the ranges of wavelengths to which the set of photodetectors is sensitive spans substantially the spectrum of visible light.

13. The method of claim 8, wherein the step of converting a set of signals from the set of photodetectors to a set of proportions of a subset of colorants in the material through a set of weightings comprises applying the set of signals to a neural network.

14. An apparatus for providing a customer selectable color marking material in a printing machine, each color marking material containing a plurality of selectable colorants, comprising:

a plurality of colorant supply receptacles, each containing a different colorant corresponding to a basic color component of a color matching system;

a colorant reservoir, having at least one of said plurality of colorant supply receptacles coupled thereto, for providing a supply of marking material having a specified color value; and a sensing device, said sensing device including means for directing light from the color marking material to a set of photodetectors, each photodetector being sensitive to a predetermined range of wavelength, and means for converting a set of signals from the set of photodetectors to a set of proportions of each of a first subset of colorants in a first color marking material through a first set of weightings, and converting a set of signals from the set of photodetectors to a set of proportions of each of a second subset of colorants in a second color marking material through a second set of weightings.

15. The apparatus of claim 14, wherein the set of photodetectors comprises more than three photodetectors.

16. The apparatus of claim 14, wherein each photodetector includes a translucent filter associated therewith.

17. The apparatus of claim 14, wherein the ranges of wavelengths to which the set of photodetectors is sensitive spans a substantially contiguous range of wavelengths.

18. The apparatus of claim 17, wherein the ranges of wavelengths to which the set of photodetectors is sensitive spans substantially the spectrum of visible light.

19. The apparatus of claim 14, wherein the means for converting a set of signals from the set of photodetectors to a set of proportions of each of the first subset of colorants in the first material through a first set of weightings comprises means for applying the set of signals to a neural network.

20. The apparatus of claim 14, wherein a weighting $A_{ni}$ relating a signal from one photosensor filtered at wavelength n to a colorant i in the first set of weightings is different from a weighting $A_{ni}$ relating a signal from the photosensor filtered at wavelength n to the colorant i in the second set of weightings.

21. The apparatus of claim 14, further comprising a system for systematically dispensing a selected amount of colorant from at least a selected one of said colorant supply receptacles to said colorant reservoir to provide a selected basic color component to said supply of marking material.

22. The apparatus of claim 21, further including a control system coupled to said sensing device for selectively actuating said systematic dispensing system in response to the measured color of said supply of marking material, said control system being operative to provide a customer selectable marking material by blending a plurality of colorants having different basic color components.

23. The apparatus of claim 22, wherein the customer selectable color is selected from a color guide illustrating a plurality of different colors, wherein said color guide further provides a specific formulation of basic color components necessary to produce the supply of marking material, and further wherein said control system is adapted to automatically blend predetermined amounts of basic color components in accordance with the specific formulation provided by said color guide.

24. The apparatus of claim 23, wherein the control system is adapted to add selected amounts of basic color components to said supply of marking material in response to the sensed color thereof for correcting the color of the supply marking material to match the customer selectable color selected from the color guide.

25. The apparatus of claim 22, wherein the control system is adapted to compare optical properties of the supply of marking material from said sensing device to respective target optical properties corresponding to said customer selectable color.

26. An apparatus for providing a customer selectable color marking material in a printing machine, each color marking material containing a plurality of selectable colorants, comprising:

a plurality of colorant supply receptacles, each containing a different colorant corresponding to a basic color component of a color matching system;

a colorant reservoir, having at least one of said plurality of colorant supply receptacles coupled thereto, for providing a supply of marking material having a specified color value; and a sensing device, said sensing device including a set of more than three photodetectors for receiving light from the color marking material, each photodetector having a translucent filter associated therewith to make the photodetector sensitive to a predetermined range of wavelength, and means for converting a set of signals from the set of photodetectors to a set of proportions of each of at least a subset of colorants in the color marking material through a set of weightings.

27. The apparatus of claim 26, the converting means including means for converting a set of signals from the set of photodetectors to a set of proportions of each of a first subset of colorants in the first color marking material through a first unique set of weightings and means for converting a set of signals from the set of photodetectors to a set of proportions of each of a second subset of colorants in a second color marking material through a second unique set of weightings.

28. The apparatus of claim 27, wherein a weighting $A_{ni}$ relating a signal from one photosensor filtered at wavelength n to a colorant i in the first set of weightings is different from a weighting $A_{ni}$ relating a signal from the photosensor filtered at wavelength n to the colorant i in the second set of weightings.

29. The apparatus of claim 26, further comprising a system for systematically dispensing a selected amount of colorant from at least a selected one of said colorant supply receptacles to said colorant reservoir to provide a selected basic color component to said supply of marking material.

30. The apparatus of claim 29, further including a control system coupled to said sensing device for selectively actuating said systematic dispensing system in response to the measured color of said supply of marking material, said control system being operative to provide a customer selectable marking material by blending a plurality of colorants having different basic color components.

31. The apparatus of claim 30, wherein the customer selectable color is selected from a color guide illustrating a plurality of different colors, wherein said color guide further provides a specific formulation of basic color components necessary to produce the supply of marking material, and further wherein said control system is adapted to automatically blend predetermined amounts of basic color components in accordance with the specific formulation provided by said color guide.

32. The apparatus of claim 31, wherein the control system is adapted to add selected amounts of basic color components to said supply of marking material in response to the sensed color thereof for correcting the color of the supply marking material to match the customer selectable color selected from the color guide.

33. The apparatus of claim 31, wherein the control system is adapted to compare optical properties of the supply of marking material from said sensing device to respective target optical properties corresponding to said customer selectable color.

34. The apparatus of claim 26, wherein the ranges of wavelengths to which the set of photodetectors is sensitive spans a substantially contiguous range of wavelengths.

35. The apparatus of claim 34, wherein the ranges of wavelengths to which the set of photodetectors is sensitive spans substantially the spectrum of visible light.

36. The apparatus of claim 26, wherein the step of converting a set of signals from the set of photodetectors to a set of proportions of a subset of colorants in the material through a set of weightings comprises applying the set of signals to a neural network.

* * * * *